US008770400B2

(12) United States Patent
Connellan et al.

(10) Patent No.: US 8,770,400 B2
(45) Date of Patent: Jul. 8, 2014

(54) PILL TRAY

(76) Inventors: James A. Connellan, Boca Raton, FL (US); William D. Moyer, Elgin, IL (US); Ryan Bruce, Phoenix, AZ (US)

( * ) Notice: Subject to any disclaimer, the term of this patent is extended or adjusted under 35 U.S.C. 154(b) by 12 days.

(21) Appl. No.: 13/468,445

(22) Filed: May 10, 2012

(65) Prior Publication Data

US 2013/0302123 A1 Nov. 14, 2013

(51) Int. Cl.
*B65D 69/00* (2006.01)

(52) U.S. Cl.
USPC ..... 206/223; 414/675

(58) Field of Classification Search
CPC ..... A61J 7/02
USPC ..... 206/232, 387.13, 564, 223, 557, 570; 220/574, 556; 414/675
See application file for complete search history.

(56) References Cited

U.S. PATENT DOCUMENTS

| | | | | |
|---|---|---|---|---|
| 2,530,009 | A | 11/1950 | Fields | |
| 3,819,064 | A | 6/1974 | Chandler | |
| 4,261,683 | A * | 4/1981 | Zaleon | 414/675 |
| 4,784,264 | A * | 11/1988 | Sykes | 206/387.13 |
| D298,968 | S | 12/1988 | McAllister | |
| 6,196,426 | B1 | 3/2001 | White | |
| 2009/0139890 | A1 * | 6/2009 | Hatcher | 206/457 |

OTHER PUBLICATIONS

Artpromos.com, "Pill Counting Tray", http://www.artpromos.com/detail.asp?id=1184[Jun. 9, 2011 3:34:36 PM]; Printed directly on plastic.
Amazon>com, Grafco Pill Counter Health & Personal Care, http://www.amazon.com/Graham-Field-Grafco-Pill-Counter/dp/B000NNHSTA[Jun. 9, 2011 3:26:15 PM].
Quality Logo Products, "Safe'n Easy Pill Counter Tray | Trade Show Giveaways", http://www.qualitylogoproducts.com/tradeshow-promotions/safen-easy-pill-counter-tray.htm[Jun. 9, 2011 3:36:34 PM].
Alibaba.com. "729006 Pill Counting Tray Sales", http://www.alibaba.com/product-gs/362922342/729006_PILL_COUNTING_TRAY/showimage.html[Jun. 9, 2011 3:30:38 PM].
Exhibits A, B, C, and D, photographs taken of prior art return spouts by Keith L. Jenkins, Applicant's attorney on Mar. 10, 2014 and appended to FOA1_Response_DO11081_signed_uploadable.pdf. The prior art photographs show return spouts on prior art, including on a Quality Logo Products pill tray.

* cited by examiner

*Primary Examiner* — David Fidei
(74) *Attorney, Agent, or Firm* — Keith L. Jenkins, Registered Patent Attorney LLC; Keith L. Jenkins

(57) ABSTRACT

A pill tray is provided for assisting in sorting and counting of pills and capsules comprising a generally flat transparent tray surrounded by walls on three sides, a pill receiver on a fourth side, and featuring at least one return funnel on a corner distal the pill receiver. The pill tray features at least one side handle, a pill receiver that extends rearward to the same extent as the return funnel, an advertising sleeve on the underside of the tray, efficient legs, a downwardly sloping return funnel with a ridge across the access to same, and a gradually sloped ridge between the tray and the pill receiver that has no flat surfaces. The pill tray is preferably formed as a single piece by injection molding. The pill tray may be part of a kit including a multi-function spatula.

21 Claims, 11 Drawing Sheets

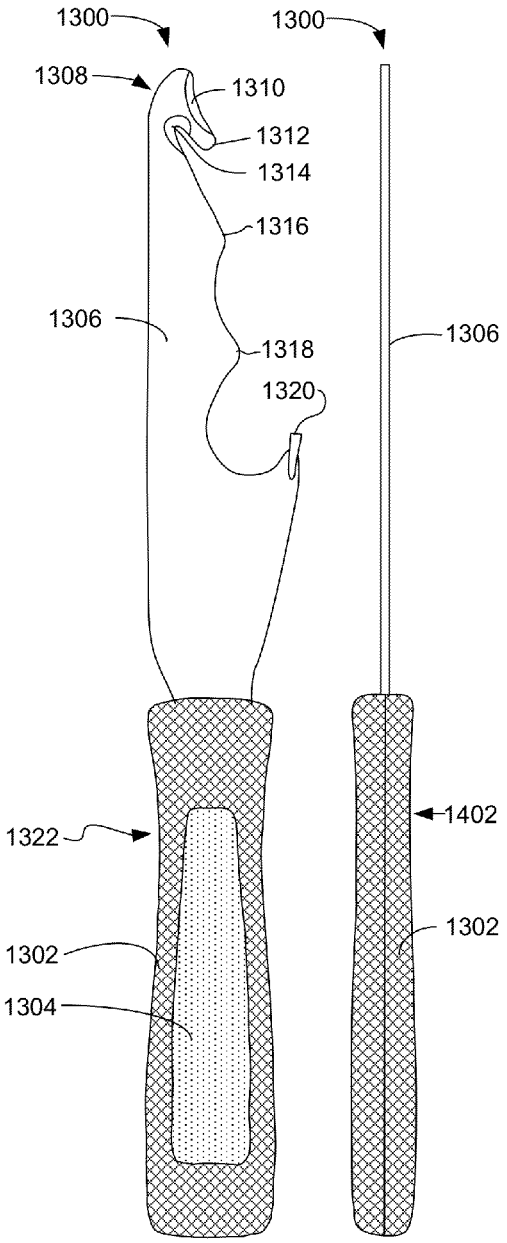
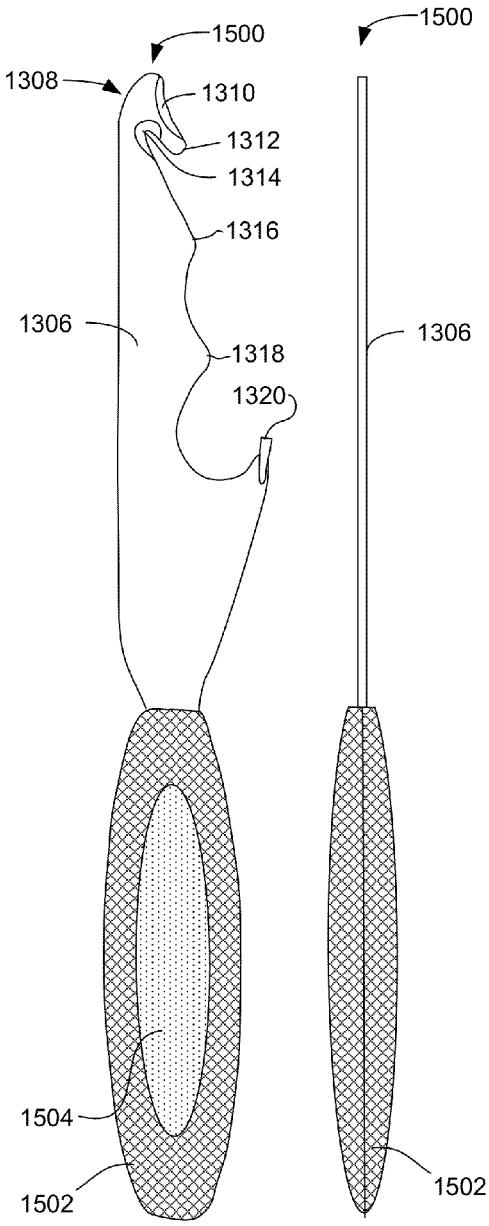
FIG. 13 FIG. 14 FIG. 15 FIG. 16

PILL TRAY

TECHNICAL FIELD

The present invention generally relates to pill trays for pharmaceutical use, and more particularly relates to an apparatus for assisting in sorting pills and capsules.

BACKGROUND

U.S. Pat. No. 25,230,009 for a PILL COUNTING DEVICE issued to M. R. Fields Nov. 14, 1950 teaches a tray coupled over an upward incline to a funnel-ended graduated pill receiver on a first tray side and an upwardly-inclining and rearward protruding return funnel at a second side corner. Fields' pill receiver has a pivotable cover which has a closure edge that is received on a flat surface of the incline between the tray and the pill receiver. The tray rests on the bottom of the pill receiver and two peg legs distal the pill receiver. The pill receiver is graduated according to pill bottle sizes, so that the pharmacist may easily determine the correct size of bottle for the number of pills prescribed. Fields teaches downward flanges underneath the tray between the legs and between the legs and the pill receiver. The rear of the pill receiver is flush with the rear edge, but the return funnel protrudes rearward. In operation, a supply of pills is poured onto the tray and the pharmacist counts the pills as they are moved via a spatula into the pill receiver. Excess pills are moved back into the supply container via the return funnel. The counted pills are funneled into a pill bottle via the funneled pill receiver. Field's device is widely used in the industry. Fields' device has, as with many other designs, a flat area on the ridge between the tray and the pill receiver where pill dust can accumulate and contaminate subsequently dispensed prescriptions. Fields' device has, as with many other designs, an upwardly inclined return funnel, which requires that the user tilt the try at a higher angle than, for example, a tray with a level return funnel. In order to tilt Fields' tray, the entire tray must be grasped.

A printable opaque tray offered for sale on Alibaba.com features a curved front corner for the tray and receives printing on the opaque tray. Top surface printing is well known but, as the printing wears off, it can contaminate a prescription.

U.S. Pat. No. 3,819,064 discloses a pill tray without a cover to the pill receiver and without a ridge between the tray and the pill receiver.

U.S. Pat. No. 6,196,426 discloses a pill receiver with funnels at both ends and a device for closing off one of the funnels, depending on whether the user is right-handed or left-handed. The tray has a flay center and sloping tray portions to the sides, which include walls. There are two return funnels distal the pill receiver. Pill counting trays with return funnels at both corners distal the pill receiver are offered for sale by ArtPromos.com, as is printing advertisement on the top surface of the opaque tray. Top surface printing is well known but, as the printing wears off, it can contaminate a prescription. The advertised device also features a transparent cover for the pill receiver.

A Grafco pill counter, offered for sale on Amazon.com is similar to the Fields design, but features a transparent tray.

A pill tray offered for sale by Quality Logo Products has a clear region in the center of the tray for receiving logo imprints.

Accordingly, it is desirable to provide a pill tray with handles for easier pouring of pills through the pill receiver funnel and the return funnel. In addition, it is desirable to provide a pill tray with a downwardly directed return funnel with a ridge across the access to the return funnel to prevent inadvertent pill migration. In addition, it is desirable to provide a pill tray with no flat surface on the ridge between the tray and the pill receiver to avoid dust accumulation. In addition, it is desirable to provide a pill tray that has advertising that is not applied to the pill-sorting surface of the tray. In addition, it is desirable to provide a pill tray that has advertising that can be changed during the life of the device. In addition, it is desirable to provide a pill tray that can be pushed flush against the wall or backsplash behind a counter upon which the pill tray rests, in order to save counter space. Furthermore, other desirable features and characteristics of the present invention will become apparent from the subsequent detailed description, taken in conjunction with the accompanying drawings and the foregoing technical field and background.

BRIEF SUMMARY

A pill tray is provided for assisting in sorting and counting of pills and capsules comprising a generally flat transparent tray surrounded by walls on three sides, a pill receiver on a fourth side, and featuring at least one return funnel on a corner distal the pill receiver. The pill tray features at least one side handle, a pill receiver that extends rearward to the same extent as the return funnel, an advertising sleeve on the underside of the tray, efficient legs, a downwardly sloping return funnel with a ridge across the access to same, and a gradually sloped ridge between the tray and the pill receiver that has no flat surfaces. The pill tray is formed as a single piece by injection molding.

The invention provides a pill tray including: an at least partially transparent tray extending from a pill receiver and having a smoothly rounded ridge and no flat surfaces between the tray and the pill receiver; and an advertising sleeve extending over a portion of an underside of the tray. The pill tray, further including a handle including a flange extending distally from the tray. The pill tray, where the handle includes a raised perimeter. The pill tray, where the pill receiver includes an axially extending funnel portion. The pill tray, further including a foot extending downward from the pill receiver. The pill tray, further including a foot extending downward from the tray, where the foot includes a horizontal and vertical curvature. The pill tray, further including a downwardly sloping return funnel extending from and accessible from the tray and having a rearward extension. The pill tray, further including a return ridge between the tray and the return funnel. The pill tray, where the pill receiver extends rearward a first extent and the rearward extension of the return funnel is equal to the first extent. The pill tray further including a spatula and a package forming a kit. The pill tray including a spatula and a package together forming a kit, wherein the spatula includes: a tip curvature corresponding to a curvature between a flat bottom portion of the pill tray and front, right, and rear sides of the pill tray; a sharpened edge for penetrating hermetic seals; a hook for extracting cotton packing materials; and a bottle cap opener for removing snap-on pill bottle caps, wherein the bottle cap opener includes first and second fulcrums corresponding to first and second bottle cap sizes.

A pill tray including: an at least partially transparent tray extending from a pill receiver and having a smoothly rounded ridge and no flat surfaces between the tray and the pill receiver; an advertising sleeve extending over a portion of an underside of the tray; and a foot extending downward from the pill receiver. The pill tray, further including a handle including a flange extending distally from the tray. The pill tray, where the handle includes a raised perimeter. The pill tray, where the pill receiver includes an axially extending funnel portion. The pill tray, further including a foot extending downward from the tray, where the foot includes a horizontal and vertical curvature. The pill tray, further including a downwardly sloping return funnel extending from and accessible from the tray and having an at least partially rearward extension. The pill tray, further including a return ridge between the tray and the return funnel. The pill tray, where the pill receiver extends rearward a first extent and the rearward extension of the return funnel is equal to the first extent.

A pill tray including: an at least partially transparent tray extending from a pill receiver and having a smoothly rounded ridge and no flat surfaces between the tray and the pill receiver; an advertising sleeve extending over a portion of an underside of the tray; a downwardly sloping return funnel extending from and accessible from the tray and having an at least partially rearward extension; and a foot extending downward from the pill receiver. The pill tray, further including a return ridge between the tray and the return funnel. The pill tray, where the pill receiver extends rearward a first extent and the rearward extension of the return funnel is equal to the first extent.

BRIEF DESCRIPTION OF THE DRAWINGS

The present invention will hereinafter be described in conjunction with the following drawing figures, wherein like numerals denote like elements.

FIG. 13 is a side elevation view illustrating a first exemplary spatula for use with the exemplary pill tray of FIG. 1, according to a preferred embodiment of the present invention;

FIG. 14 is a front elevation view illustrating the first exemplary spatula of FIG. 13 for use with the exemplary pill tray of FIG. 1, according to a preferred embodiment of the present invention;

FIG. 15 is a side elevation view illustrating a second exemplary spatula for use with the exemplary pill tray of FIG. 1, according to a preferred embodiment of the present invention;

FIG. 16 is a back elevation view illustrating the second exemplary spatula of FIG. 15 for use with the exemplary pill tray of FIG. 1, according to a preferred embodiment of the present invention;

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
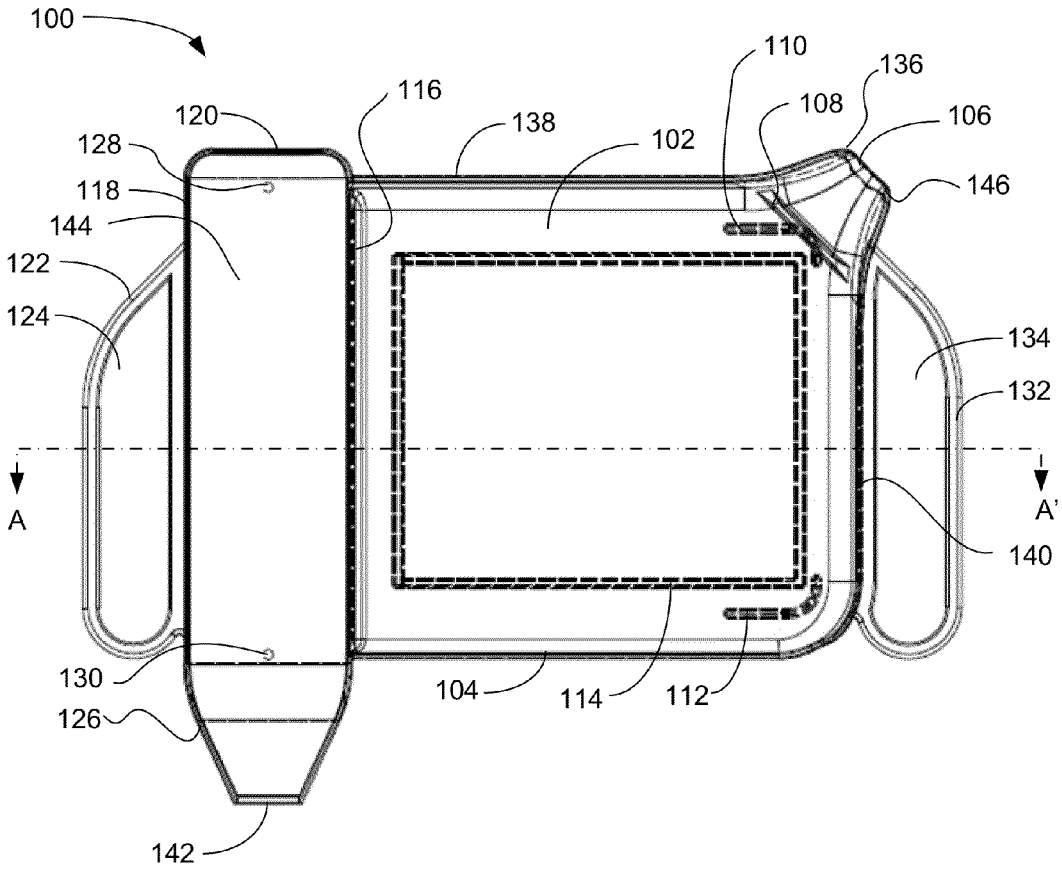
FIG. 1 is a top plan wire frame view illustrating an exemplary pill tray and defining a cross-section AA', according to a preferred embodiment of the present invention.

FIG. 1 is a top plan wire frame view illustrating an exemplary pill tray 100 and defining a cross-section AA', according to a preferred embodiment of the present invention. Tray 102 has a rear wall 138, a front wall 104, and a side wall 140 with the directions referenced to FIG. 1 with rear at the top of the drawing. Pill receiver 144 lies along the left edge of the tray 102 and is separated from the tray 102 by a sloping ridge 116 that has no flat surfaces. Flat surfaces on the ridge 116 or between tray 102 and pill receiver 144 are preferably avoided to avoid pill dust accumulation on such flat surfaces. Rear wall 138, front wall 104, and side wall 140 curve upward from tray 102 with a predetermined curvature 902 (see FIG. 9).

Pill receiver 144 has a front funnel portion 126 with a funnel opening 142 for pouring counted pills in the pill receiver 144 into dispensing pill bottles. The external side of pill receiver 144 supports a handle 124, preferably with a raised perimeter 122. Pill receiver 144 is shown without a closable lid. In some alternate embodiments, a closable lid may be provided. In such an alternate embodiment, the edge of the lid that meets the ridge 116 will be shaped conformally to the curvature of the ridge 116. The rear wall 120 of pill receiver 144 extends rearward of the rear wall 138 to the same extent as rearmost extension 136 of return funnel 106, in order that the pill tray 100 will sit flush against a wall behind a counter upon which the pill tray 100 has been placed.

Handle 134 extends from the right wall 140 and preferably includes a raised perimeter 132. Preferably, the length dimension extension of the right handle 134 rightward of the rightmost extent 146 of return funnel 106 added to the length dimension of the leftmost extension of the left handle 124 from the pill receiver 144 is no greater that the leftward extent of an open lid, or cover, for the pill receiver 144, as shown.

Accordingly, the pill tray 100 takes up no greater footprint on a counter top than a prior art device of the same tray 102 size with its cover open. That is, the operating footprint of the pill tray 100 on a countertop is not increased relative to equivalent-capacity prior art devices. While the left and right extents of the handles 124 and 134, respectively, are limitations of this exemplary embodiment of the pill tray 100, the handle shape shown is not a limitation. It is within the scope of the present invention to have the surfaces of the handles 124 and 134 be suitable for displaying advertising. In some alternate embodiments, the left and right extensions of the handles may increase the operating footprint of the pill tray 100.

The underside of pill receiver 144 has a front foot 130 and a rear foot 128. The underside of tray 102 has advertising sleeve 114 and front tray foot 112 and rear tray foot 110. Advertising sleeve 114 receives advertising media, such as printed media, that displays advertising to the user through transparent pill tray 102. The media is preferably received in a slot 602 (see FIG. 6) between front tray foot 112 and rear tray foot 110. Note that the horizontally curved portions of front tray foot 112 and rear tray foot 110 do not obstruct access to slot 602. Advertising sleeve 114 may be of various sizes, and is preferably at least large enough to receive a conventional business card. Tray 102 is preferably entirely transparent, however, in various alternate embodiments, tray 102 may be transparent only over the advertising sleeve or made of colored transparent material.

Downwardly sloping return funnel 106 extends from rear wall 138 and right wall 140 and has a return ridge 108 to prevent inadvertent pill migration out of the return funnel 106. Rear wall 138 extends downwardly to one side of return funnel 106 and side wall 140 first extends in height (See ref 502 in FIG. 5) and then extends downwardly in height to form return funnel 106.

Figure 2:
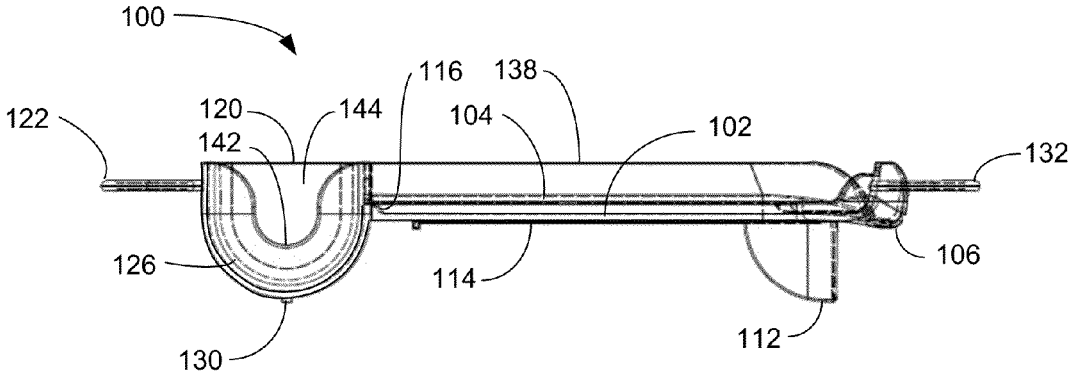
FIG. 2 is a front elevation wire frame view illustrating the exemplary pill tray of FIG. 1, according to a preferred embodiment of the present invention.

FIG. 2 is a front elevation wire frame view illustrating the exemplary pill tray 100 of FIG. 1, according to a preferred embodiment of the present invention. The pill receiver 144 has sufficient depth between the bottom of funnel opening 142 and the bottom of the pill receiver 144 to accommodate a volume of pills sufficient to fill a prescription. Seen with FIG. 1, the vertical edge curvature of front tray foot 112 is apparent and tray foot 110 is preferably formed in mirror image shape to front tray foot 112. The height of rear wall 138 is flush with the height of pill receiver 144 and the height of front wall 104 is flush with the height of the ridge 116. Return funnel 106 is preferably downward sloping, as shown, which reduces the amount that the pill tray 100 must be tilted to return unused pills to a storage or supply container.

Figure 3:
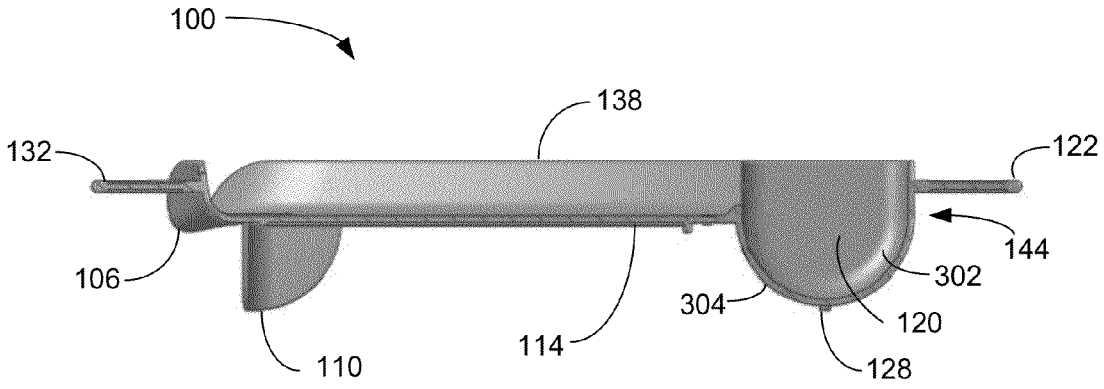
FIG. 3 is a rear shaded view illustrating the exemplary pill tray of FIG. 1, according to a preferred embodiment of the present invention.

FIG. 3 is a rear shaded elevation view illustrating the exemplary pill tray 100 of FIG. 1, according to a preferred embodiment of the present invention. Rear wall 120 of pill receiver 144 preferably has an arcuate lower perimeter 302 extending into the semi cylindrical main trough 304 of pill receiver 144, as shown. The vertical edge curvature and horizontal curvature of rear tray foot 110 can be seen. The design of the rear tray foot 110 and front tray foot 112 avoids the need for a flange extending between the tray feet 110, 112 or from the tray feet 110, 112 to the pill receiver 144.

Figure 4:
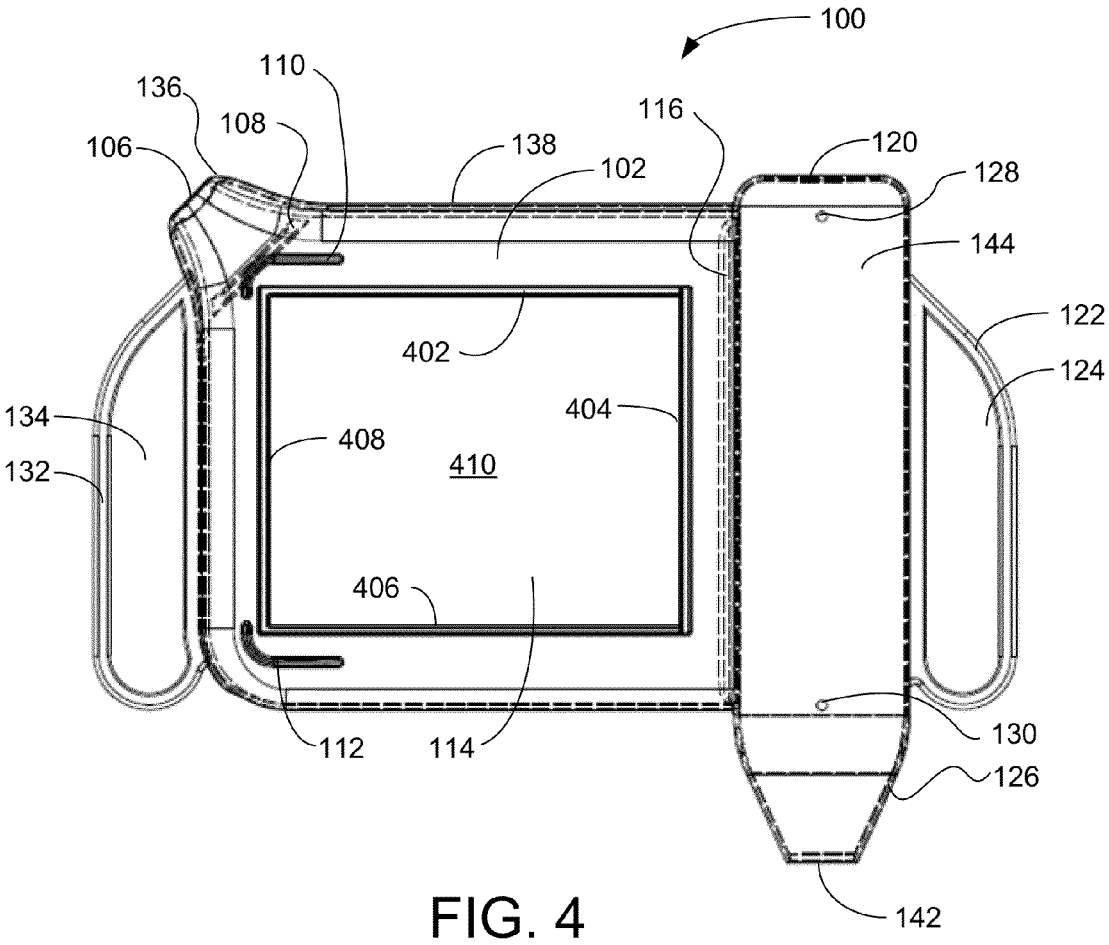
FIG. 4 is a bottom view plan wire frame view illustrating the exemplary pill tray of FIG. 1, according to a preferred embodiment of the present invention.

FIG. 4 is a bottom view plan wire frame view illustrating the exemplary pill tray 100 of FIG. 1, according to a preferred embodiment of the present invention. Advertising sleeve 114 has sides 402, 404, and 406 that extend from the underside of tray 102 to advertising sleeve panel 410. Advertising sleeve 114 also has sleeve edge 408 that does not extend to the underside of tray 102, but remains open to form slot 602 (see FIG. 6) for receiving advertising media. The advantages of advertising sleeve 114 over the prior art are that the advertising media are replaceable, making the pill tray 100 more fungible; and the print does not contact the medications being counted on the top surface of tray 102.

Figure 5:
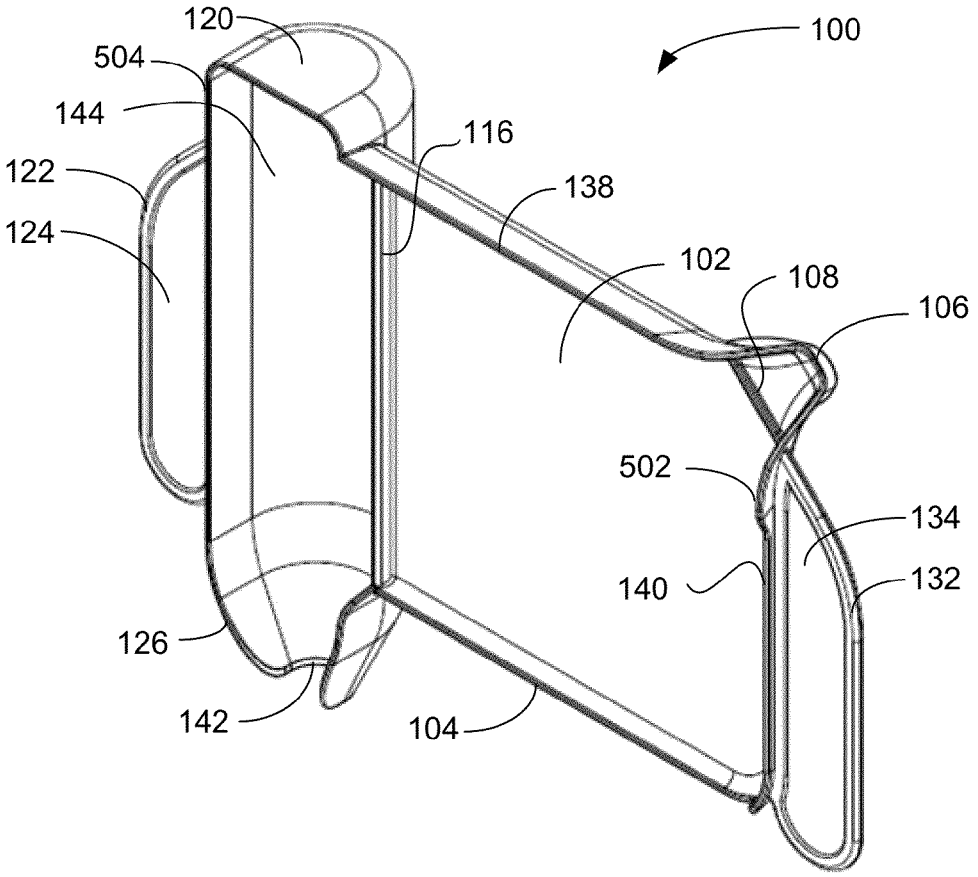
FIG. 5 is a top-right perspective wire frame view illustrating the exemplary pill tray of FIG. 1, according to a preferred embodiment of the present invention.

FIG. 5 is a top-right perspective wire frame view illustrating the exemplary pill tray 100 of FIG. 1, according to a preferred embodiment of the present invention. Side wall 140 is higher than front wall 104, and side wall 140 extends further to an increased height 502 before extending downward and outward to form return funnel 106. While the rear wall 138, front wall 104, and side wall 140 are shown as primarily straight and of even height, such features are exemplary rather than limiting. The top edge 504 of pill receiver 144 is similarly not limited to be straight or of even height.

Figure 6:
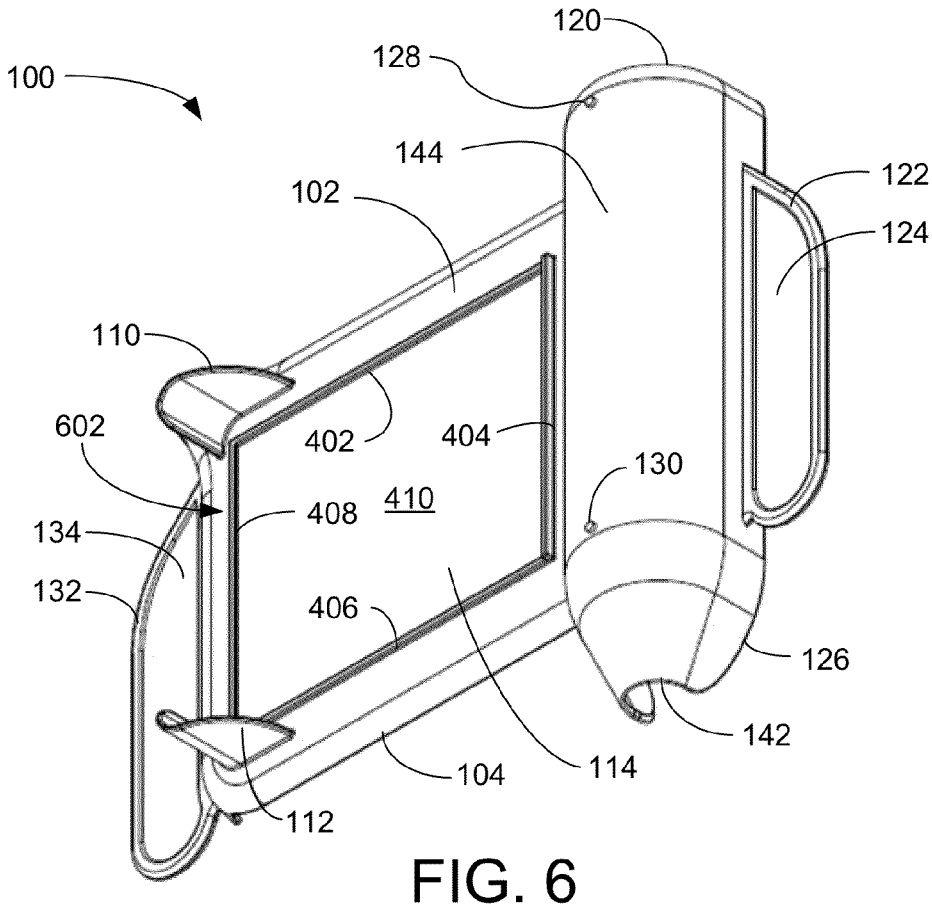
FIG. 6 is a bottom-left-front perspective wire frame view illustrating the exemplary pill tray of FIG. 1, according to a preferred embodiment of the present invention.

FIG. 6 is a bottom-left-front perspective wire frame view illustrating the exemplary pill tray 100 of FIG. 1, according to a preferred embodiment of the present invention. Slot 602 under edge 408 of advertising sleeve 114 is operable to slidingly receive printed advertising media. Front foot 130 and a rear foot 128 provide additional stability over prior art devices, in which minor irregularities in the manufacture of the pill receiver 144 can cause unexpected tilting during operation. The inner curvature of rear tray foot 110 is visible.

Figure 7:
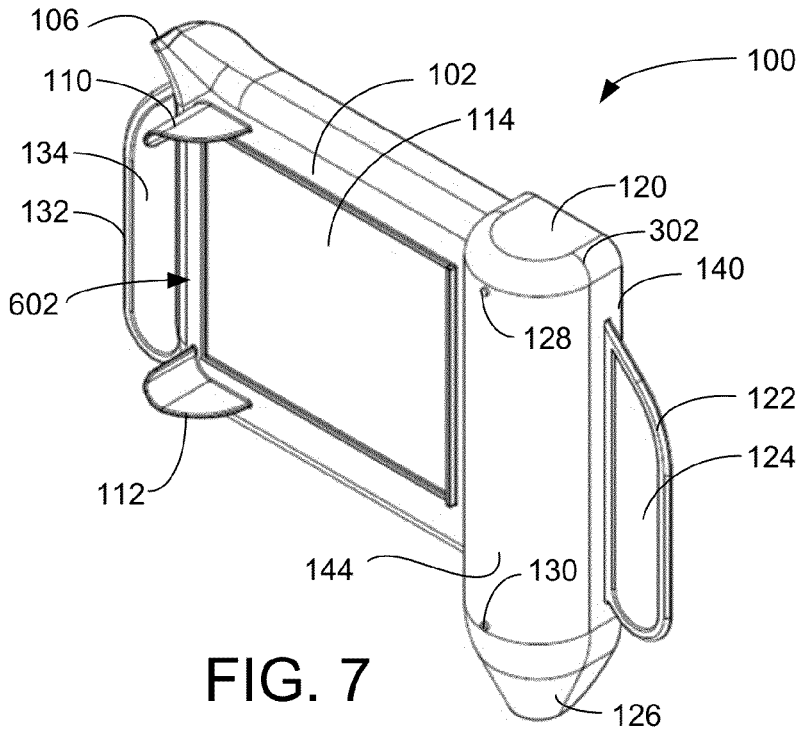
FIG. 7 is a bottom-left-rear perspective wire frame view illustrating the exemplary pill tray of FIG. 1, according to a preferred embodiment of the present invention.

FIG. 7 is a bottom-left-rear perspective wire frame view illustrating the exemplary pill tray 100 of FIG. 1, according to a preferred embodiment of the present invention. The inner curvature of front tray foot 112 is visible.

Figure 8:
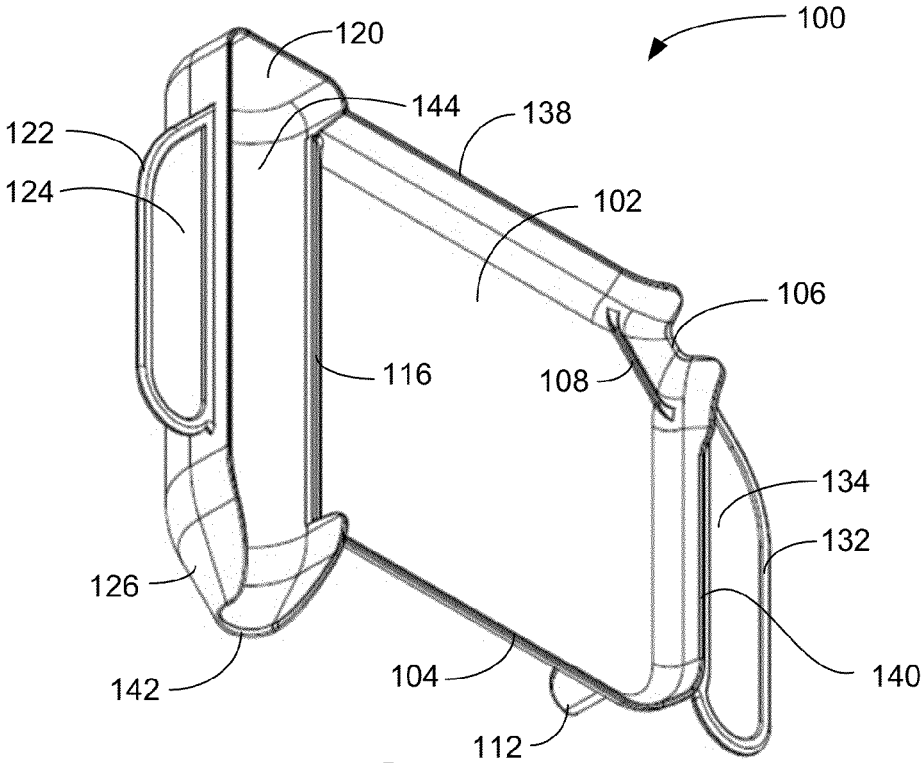
FIG. 8 is a top-left-front perspective wire frame view illustrating the exemplary pill tray of FIG. 1, according to a preferred embodiment of the present invention.

FIG. 8 is a top-left-front perspective wire frame view illustrating the exemplary pill tray 100 of FIG. 1, according to a preferred embodiment of the present invention. Return ridge 108 is best displayed in this view. Return ridge 108 assists in preventing pills from exiting the tray during counting operations, but is not so high as to prevent pills from exiting when the pill tray 100 is tilted to return unused pills to the supply container. Like ridge 116, return ridge 108 is rounded and has no flat surfaces. The entire pill tray 100 is preferably made as one piece of injection molded plastic, including return ridge 108.

Figure 9:
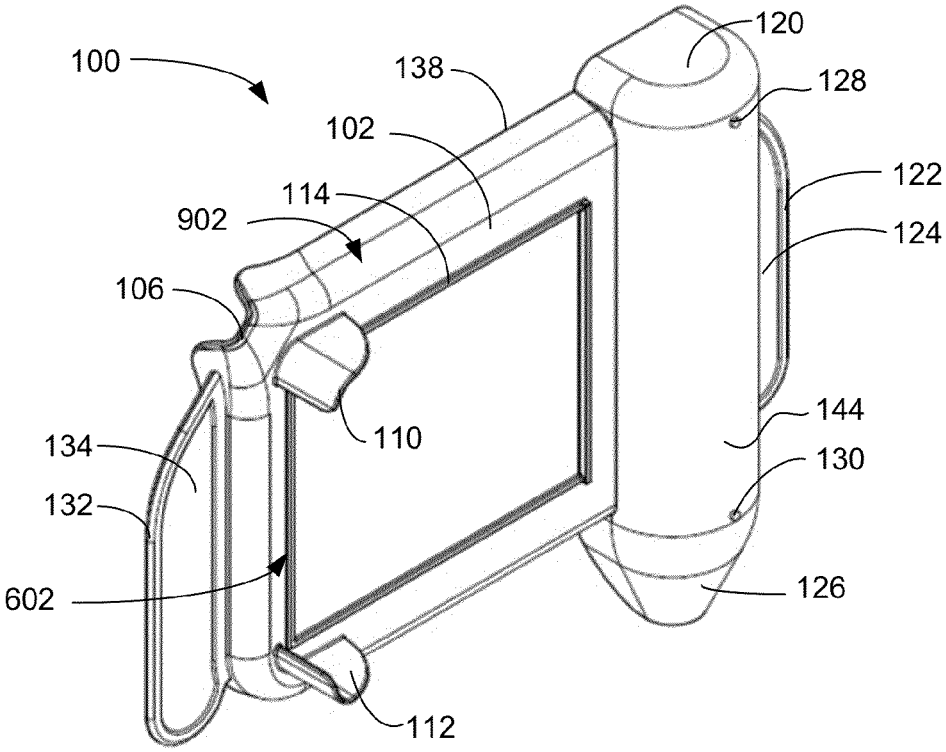
FIG. 9 is a bottom-right-rear perspective wire frame view illustrating the exemplary pill tray of FIG. 1, according to a preferred embodiment of the present invention.

FIG. 9 is a bottom-right-rear perspective wire frame view illustrating the exemplary pill tray 100 of FIG. 1, according to a preferred embodiment of the present invention. Slot 602 may be clearly seen in this view. Extending tray 102 into rear wall 138 is a predetermined curvature 902, which reduces pill dust accumulation.

Figure 10:
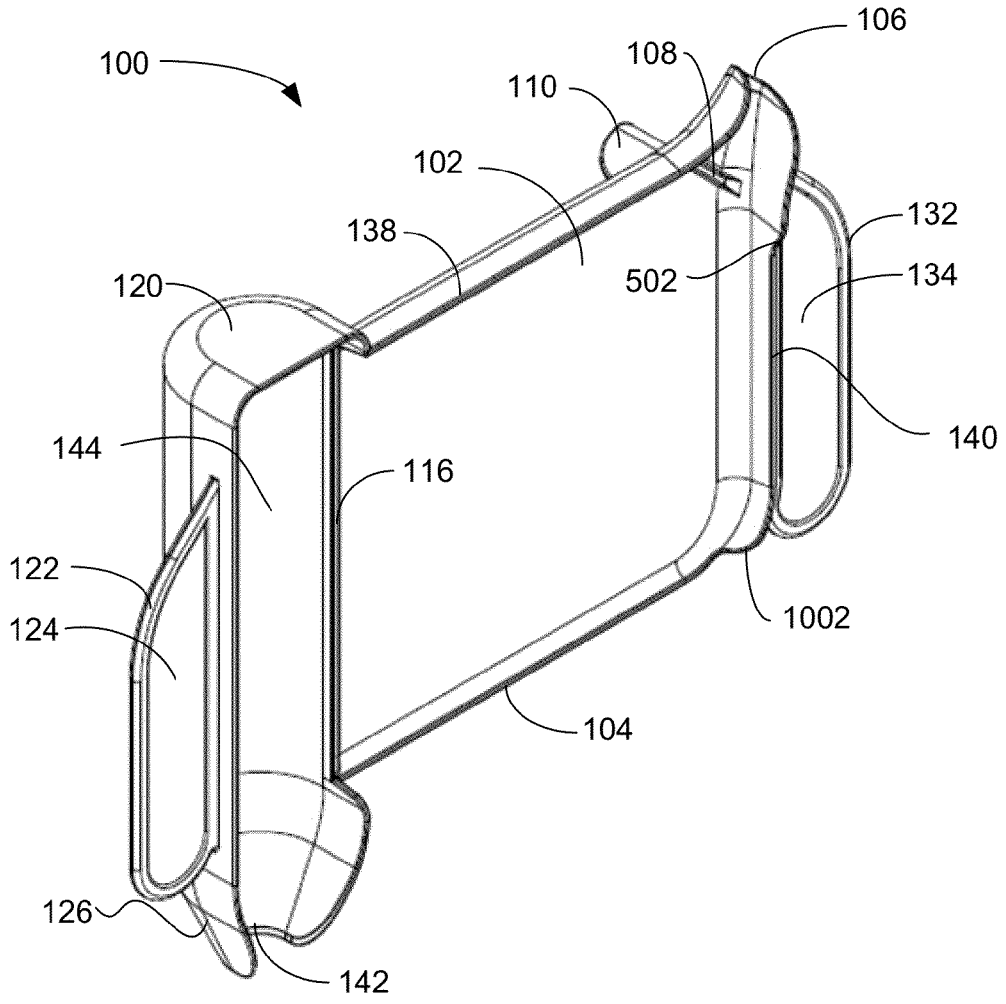
FIG. 10 is a front-left-rear perspective wire frame view illustrating the exemplary pill tray of FIG. 1, according to a preferred embodiment of the present invention.

FIG. 10 is a front-left-rear perspective wire frame view illustrating the exemplary pill tray 100 of FIG. 1, according to a preferred embodiment of the present invention. The corner between front wall 104 and side wall 140 is curved, as shown, and extension 1002 from the height of the front wall 104 to the height of side wall 140 is achieved in the curved corner.

Figure 11:
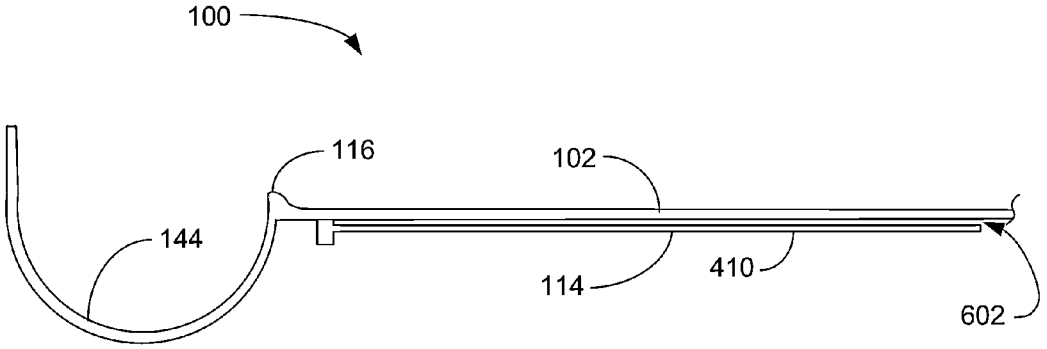
FIG. 11 is a partial cross-sectional view through cross section AA' illustrating details of the exemplary advertising sleeve on the underside of the tray of the exemplary pill tray of FIG. 1, according to a preferred embodiment of the present invention.

FIG. 11 is a partial cross-sectional view through cross section AA' from FIG. 1 illustrating details of the exemplary advertising sleeve 114 on the underside of the tray 102 of the exemplary pill tray 100 of FIG. 1, according to a preferred embodiment of the present invention. The curvature of ridge 116 can be seen in this cross section. The slot 602 for receiving advertising media is between tray 102 and panel 410 and is preferably sized to receive printed card stock.

Figure 12:
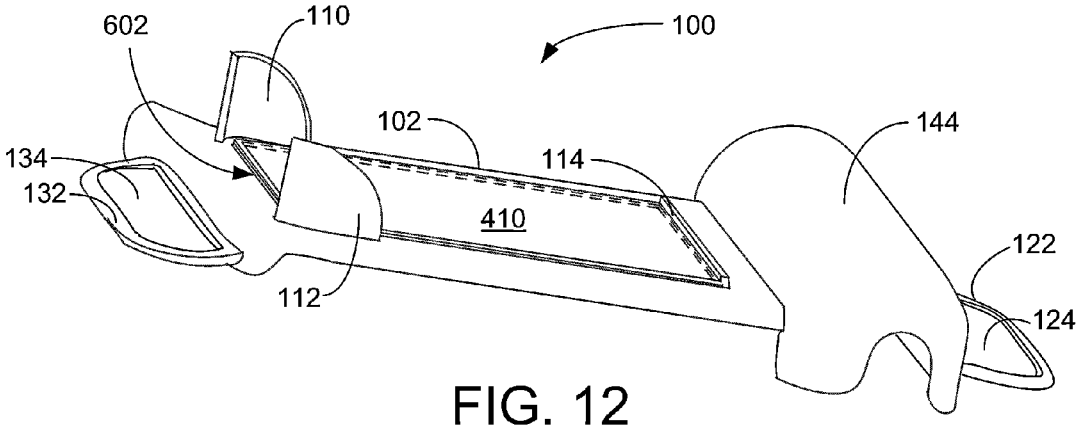
FIG. 12 is a bottom-right-front perspective view AA' illustrating details of the exemplary advertising sleeve on the underside of the tray of the exemplary pill tray of FIG. 1, according to a preferred embodiment of the present invention.

FIG. 12 is a bottom-right-front perspective view AA' illustrating details of the exemplary advertising sleeve 114 on the underside of the tray 102 of the exemplary pill tray 100 of FIG. 1, according to a preferred embodiment of the present invention. The access to slot 602 is between front tray leg 112 and rear tray leg 110. In some alternate embodiments access may be changed by providing a front or rear slot 602, with appropriate changes to the front tray leg 112 and rear tray leg 110. A slot 602 proximate the pill receiver 144 is possible, but not required. The alignment of the advertising sleeve 114 with the sides of the tray 102 is merely exemplary: other orientations and shapes of advertising sleeve 114 are possible in various alternate embodiments.

FIG. 13 is a side elevation view illustrating a first exemplary spatula 1300 for use with the exemplary pill tray 100 of FIG. 1, according to a preferred embodiment of the present invention. Spatula 1300 is preferably sold in a kit with pill tray 100. Spatula 1300 includes a handle 1302 and a blade 1306 extending from the handle portion. Handle 1302 includes an inset 1304 that is suitable for bearing advertising and an indentation 1322 for ease of handling. Handle 1302 has a surface for assisting in gripping the spatula 1300.

Spatula 1300 is a multi-functional device. The curvature 1308 of the tip of the blade 1306 preferably matches the particular curvature 902 between the pill tray 102 and the back wall 139, side wall 140, and front wall 104 and so is preferably shaped to be interoperable with pill tray 100. Sharpened edge 1310 is used for initially penetrating hermetic seals on pill supply bottles when first opening such bottles. Inner edge 1314 is also used for cutting hermetic seals once they have been penetrated using sharpened edge 1310. Hook 1312 is used for extracting packing material, such as cotton, that is used in pill supply bottles to reduce damage to the pills during shipping. Opener 1320 is used for removing snap-on caps from pill bottles with fulcrums 1318 and 1316 corresponding to caps of different sizes. The back edge of blade 1306 is rounded to reduce friction in moving across pill tray 100.

The spatula 1300 preferably has a plastic handle 1302 and a metal blade 1306. In alternate embodiments, other materials may be used such as, for non-limiting examples, all metal or all plastic. No limit on the materials used to make spatula 1300 is intended, beyond the limitation that the materials must support the function of spatula 1300.

FIG. 14 is a front elevation view illustrating the first exemplary spatula 1300 of FIG. 13 for use with the exemplary pill tray 100 of FIG. 1, according to a preferred embodiment of the present invention. As can be seen, blade 1306 can be made from flat metal stock or other flat stock. Indentation 1402 provides for ease of handling. In an alternate embodiment, opener 1320 may be wider than the blade 1306.

FIG. 15 is a side elevation view illustrating a second exemplary spatula 1500 for use with the exemplary pill tray 100 of FIG. 1, according to a preferred embodiment of the present invention. Blade 1306 is the same as for spatula 1300, but handle 1502 has a different shape. Inset 1504 provides a surface for bearing advertising while handle 1502 has a surface for assisting in gripping the spatula 1500. In various alternate embodiments, handles 1302 and 1502 of various shapes may be used, within the limits of the functionality of spatula 1300 or 1500.

FIG. 16 is a back elevation view illustrating the second exemplary spatula 1300 of FIG. 15 for use with the exemplary pill tray 100 of FIG. 1, according to a preferred embodiment of the present invention. The back edge of blade 1306 is rounded to reduce friction in moving across pill tray 100.

Figure 17:
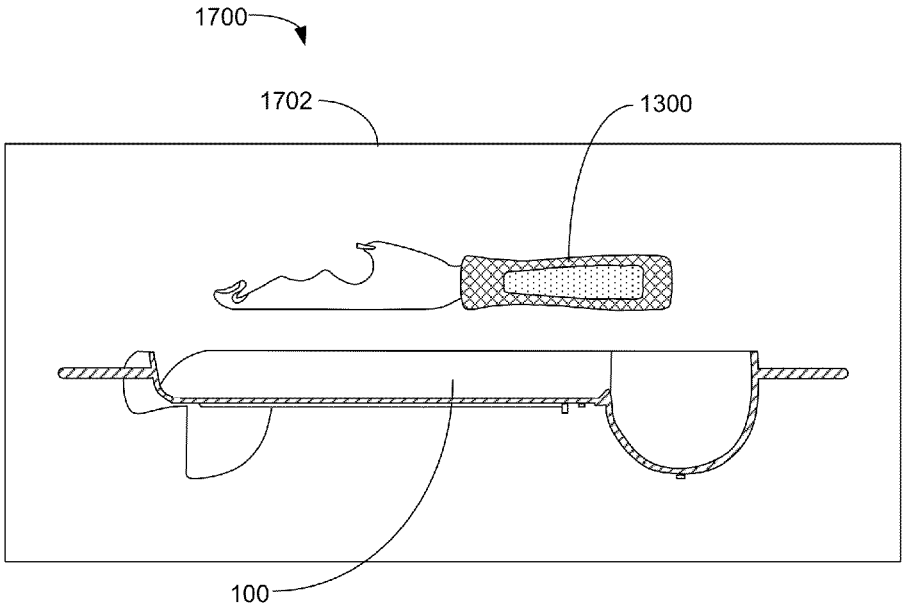
FIG. 17 is a diagrammatic view illustrating a first exemplary kit, according to a preferred embodiment of the present invention.

FIG. 17 is a diagrammatic view illustrating an exemplary kit 1700, according to a preferred embodiment of the present invention. Package 1702 may be any type of device for containing or associating spatula 1300 and pill tray 100. Kit 1700 may optionally contain advertising media for insertion in slot 602 of pill tray 100 and may provide such advertising media already within slot 602. Kit 1700 may optionally contain a supply of pills.

Figure 18:
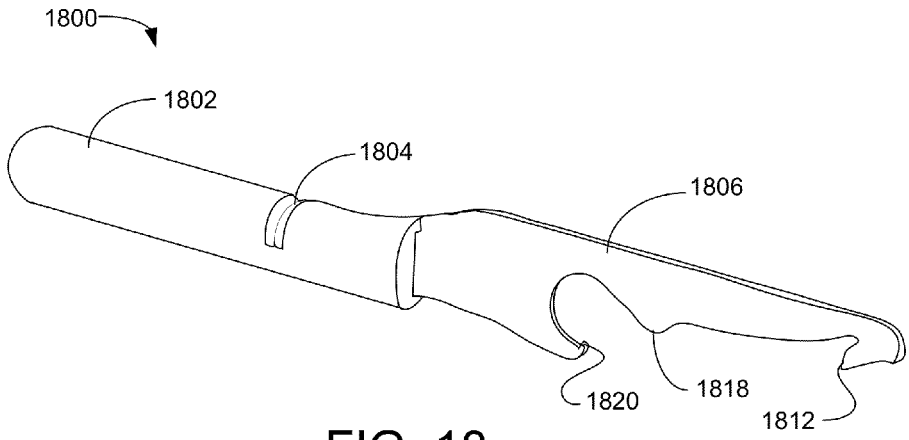
FIG. 18 is a perspective view illustrating a third exemplary spatula for use with the exemplary pill tray of FIG. 1, according to a preferred embodiment of the present invention.

FIG. 18 is a perspective view illustrating a third exemplary spatula 1800 for use with the exemplary pill tray 100 of FIG. 1, according to a preferred embodiment of the present invention. Handle 1802 has a notch 1804 that is sized and shaped complimentary to the funnel opening 142 that allows the spatula 1800 to rest, in a stable manner, in the pill receiver 144 (See FIG. 19) when not in use. Blade 1806 has a single fulcrum 1818 for the bottle cap opener 1820. Variation in the shape of the bottle cap openers 1820 and 1320 may be seen, and is within the scope of the present invention as long as the functionality is preserved. Tips 1812 and 1312 also shows some variation in configuration.

Figure 19:
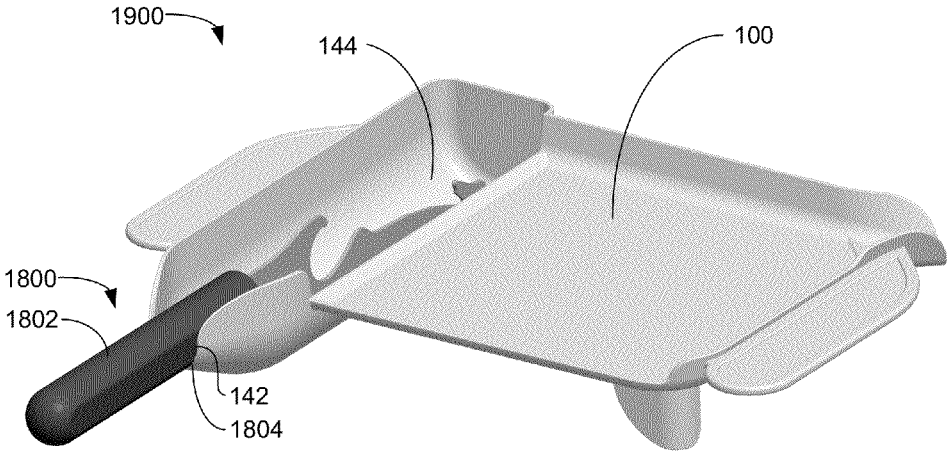
FIG. 19 is a perspective view illustrating a second exemplary kit, according to a preferred embodiment of the present invention.

FIG. 19 is a perspective view illustrating a second exemplary kit 1900, according to a preferred embodiment of the present invention. Kit 1900 includes pill tray 100 and spatula 1800. Pill tray 100, shown as opaque for simplicity of illustration, is provided as a kit with spatula 1800. Spatula 1800 is shown in its stable resting position with notch 1804 receiving a portion of funnel opening 142 when the kit is not in use. The shipping configuration of the kit 1900 may be different from that shown, depending on the packaging chosen. Kit 1900 may optionally contain advertising media for insertion in slot 602 of pill tray 100 and may provide such advertising media already within slot 602. Kit 1900 may optionally contain a supply of pills.

Figure 20:
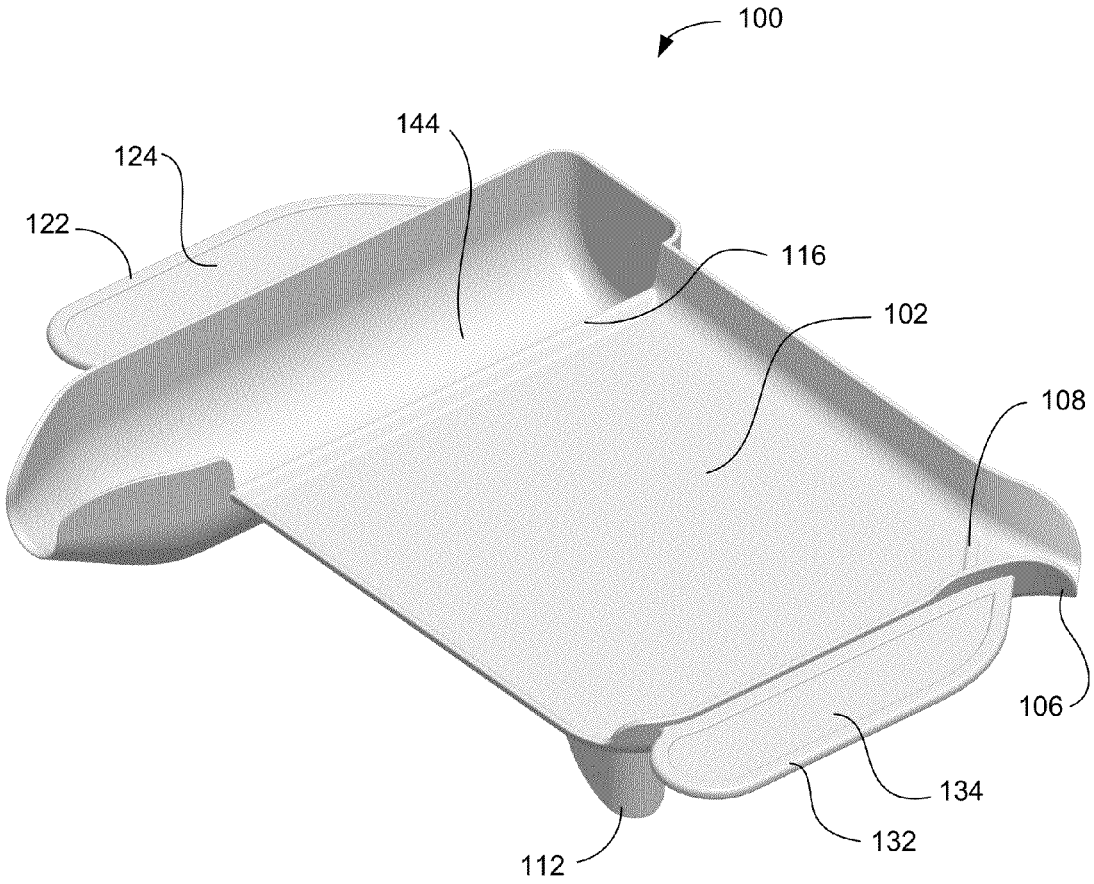
FIG. 20 is a perspective shaded view illustrating the exemplary pill tray of FIG. 1, according to a preferred embodiment of the present invention.

FIG. 20 is a perspective shaded view illustrating the exemplary pill tray 100 of FIG. 1, according to a preferred embodiment of the present invention. Pill tray 100 is shown as opaque for simplicity of illustration, but is normally transparent. In an alternate embodiment, portions of pill tray 100 may be opaque. Reviewing some of the unique features, pill tray 100 has a downward return funnel 106 and a return ridge 108. The pill receiver is separated from the tray 102 by a rounded ridge 116. Handles 124 and 134 have raised perimeter 122 and 132, respectively. Horizontally and vertically curved foot 112 is also seen.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description and the claims will provide those skilled in the art with a convenient road map for implementing the exemplary embodiment or exemplary embodiments. It should be understood that various changes can be made in the function and arrangement of elements without departing from the scope of the invention.

We claim:

1. A pill tray comprising:

a. an at least partially transparent tray extending from a pill receiver and having only a smoothly rounded ridge between said tray and said pill receiver; and b. an advertising sleeve extending over a portion of an underside of said tray and visible from a top side of said tray;

c. at least one return funnel extending downwardly from a top pill-supporting surface of said tray and accessible from said top pill-supporting surface of said tray and having an at least partially rearward extension; and d. a return ridge between said tray and said return funnel.

2. The pill tray of claim 1, further comprising at least one handle comprising a flange extending distally from said tray.

3. The pill tray of claim 2, wherein said at least one handle comprises a raised perimeter.

4. The pill tray of claim 1, wherein said pill receiver comprises an axially extending funnel portion.

5. The pill tray of claim 1, further comprising at least one foot extending downward from said pill receiver.

6. The pill tray of claim 1, further comprising at least one foot extending downward from said tray, wherein said at least one foot comprises a horizontal and vertical curvature.

7. The pill tray of claim 1, wherein said pill receiver extends rearward a first extent and said rearward extension of said return funnel is equal to said first extent.

8. The pill tray of claim 1, further comprising a spatula and a package forming a kit.

9. The pill tray of claim 8, comprising a spatula and a package together forming a kit, wherein said spatula includes a blade comprising:

a. a tip curvature corresponding to a curvature between a flat bottom portion of said pill tray and front, right, and rear sides of said pill tray;

b. a sharpened edge for penetrating hermetic seals;

c. a hook for extracting packing materials from pill bottles; and d. a bottle cap opener for removing snap-on pill bottle caps, wherein said bottle cap opener comprises first and second fulcrums corresponding to first and second bottle cap sizes.

10. A pill tray comprising:

a. an at least partially transparent tray extending from a pill receiver and having only a smoothly rounded ridge between said tray and said pill receiver;

b. an advertising sleeve extending over a portion of an underside of said tray; and c. at least one foot extending downward from said pill receiver;

d. a return funnel extending downwardly from a top pill-supporting surface of said tray and accessible from said top pill-supporting surface of said tray and having an at least partially rearward extension; and e. a return ridge between said tray and said return funnel.

11. The pill tray of claim 10, further comprising at least one handle comprising a flange extending distally from said tray.

12. The pill tray of claim 11, wherein said at least one handle comprises a raised perimeter.

13. The pill tray of claim 10, wherein said pill receiver comprises an axially extending funnel portion.

14. The pill tray of claim 10, further comprising at least one foot extending downward from said tray, wherein said at least one foot comprises a horizontal and a vertical curvature.

15. The pill tray of claim 10, wherein said pill receiver extends rearward a first extent and said rearward extension of said return funnel is equal to said first extent.

16. The pill tray of claim 10, further comprising a spatula and a package forming a kit.

17. The pill tray of claim 16, comprising a spatula and a package together forming a kit, wherein said spatula includes a blade comprising:

a. a tip curvature corresponding to a curvature between a flat bottom portion of said pill tray and front, right, and rear sides of said pill tray;

b. a sharpened edge for penetrating hermetic seals;

c. a hook for extracting packing materials from pill bottles; and d. a bottle cap opener for removing snap-on pill bottle caps, wherein said bottle cap opener comprises first and second fulcrums corresponding to first and second bottle cap sizes.

18. A pill tray comprising:

a. an at least partially transparent tray extending from a pill receiver and having only a smoothly rounded ridge between said tray and said pill receiver;

b. an advertising sleeve extending over a portion of an underside of said tray;

c. a return funnel extending downwardly from a top pill-supporting surface of said tray and accessible from said top-pill-supporting surface of said tray and having an at least partially rearward extension;

d. at least one foot extending downward from said pill receiver; and e. a return ridge between said tray and said return funnel.

19. The pill tray of claim 18, wherein said pill receiver extends rearward a first extent and said rearward extension of said return funnel is equal to said first extent.

20. The pill tray of claim 18, further comprising a spatula and a package forming a kit.

21. The pill tray of claim 20, comprising a spatula and a package together forming a kit, wherein said spatula includes a blade comprising:

a. a tip curvature corresponding to a curvature between a flat bottom portion of said pill tray and front, right, and rear sides of said pill tray;

b. a sharpened edge for penetrating hermetic seals on pill bottles;

c. a hook for extracting packing materials from pill bottles; and d. a bottle cap opener for removing snap-on pill bottle caps, wherein said bottle cap opener comprises first and second fulcrums corresponding to first and second bottle cap sizes.

* * * * *